US009683568B2

(12) United States Patent
Choi et al.

(10) Patent No.: US 9,683,568 B2
(45) Date of Patent: Jun. 20, 2017

(54) SCROLL COMPRESSOR HAVING AN AREA OF BYPASS HOLES FORMED AT A COMPRESSION CHAMBER WITH A LARGER VOLUME REDUCTION GRADIENT LARGER THAN AN AREA OF BYPASS HOLES AT THE OTHER COMPRESSION CHAMBER

(71) Applicant: LG ELECTRONICS INC., Seoul (KR)

(72) Inventors: Yongkyu Choi, Seoul (KR); Inho Won, Seoul (KR); Cheolhwan Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/782,080

(22) PCT Filed: May 19, 2014

(86) PCT No.: PCT/KR2014/004460
§ 371 (c)(1),
(2) Date: Oct. 2, 2015

(87) PCT Pub. No.: WO2014/189240
PCT Pub. Date: Nov. 27, 2014

(65) Prior Publication Data

US 2016/0040667 A1 Feb. 11, 2016

(30) Foreign Application Priority Data

May 21, 2013 (KR) ..... 10-2013-0057316

(51) Int. Cl.
*F03C 2/00* (2006.01)
*F03C 4/00* (2006.01)
(Continued)

(52) U.S. Cl.
CPC ..... *F04C 18/0261* (2013.01); *F01C 1/0215* (2013.01); *F01C 1/0261* (2013.01);
(Continued)

(58) Field of Classification Search
CPC .. F04C 18/0215; F04C 18/0261; F04C 28/26; F04C 15/06; F04C 29/12; F04C 23/008;
(Continued)

(56) References Cited

U.S. PATENT DOCUMENTS 6,379,123 B1 4/2002 Makino et al.
2010/0221133 A1* 9/2010 Nishikawa ..... F04C 18/0215 418/55.5
2013/0089449 A1 4/2013 Seong et al.

FOREIGN PATENT DOCUMENTS

CN 101675248 3/2010
CN 102052310 5/2011
(Continued)

OTHER PUBLICATIONS

International Search Report and Written Opinion dated Sep. 23, 2014 issued in Application No. PCT/KR2014/004460.
(Continued)

*Primary Examiner* — Theresa Trieu
(74) *Attorney, Agent, or Firm* — Ked & Associates LLP

(57) ABSTRACT

A scroll compressor is provided. The scroll compressor may include a fixed scroll including a fixed wrap, and an orbiting scroll including an orbiting wrap coupled to the fixed wrap to form a pair of compression chambers. An entire cross-sectional area of bypass holes formed at a compression chamber with a larger volume reduction gradient between the compression chambers may be formed to be larger than an entire cross-sectional area of bypass holes formed at the other compression chamber to prevent over-compression at the compression chamber with the larger volume reduction
(Continued)

gradient, thereby enhancing an entire efficiency of the compressor.

17 Claims, 6 Drawing Sheets

(51) Int. Cl.

| | |
|---|---|
| ***F04C 2/00*** | (2006.01) |
| ***F04C 18/00*** | (2006.01) |
| ***F04C 18/02*** | (2006.01) |
| ***F04C 29/12*** | (2006.01) |
| ***F01C 1/02*** | (2006.01) |
| ***F04C 15/06*** | (2006.01) |
| ***F04C 28/26*** | (2006.01) |
| *F04C 23/00* | (2006.01) |

(52) U.S. Cl.
CPC ..... *F04C 15/06* (2013.01); *F04C 18/0215* (2013.01); *F04C 18/0246* (2013.01); *F04C 28/26* (2013.01); *F04C 29/12* (2013.01); *F04C 23/008* (2013.01); *F04C 2240/808* (2013.01); *F04C 2270/195* (2013.01); *F04C 2270/80* (2013.01); *F04C 2270/86* (2013.01)

(58) Field of Classification Search
CPC ... F04C 18/0246; F01C 1/0215; F01C 1/0261
USPC ..... 418/55.1–55.6, 57, 15, 180; 417/308, 417/310, 440
See application file for complete search history.

(56) References Cited

FOREIGN PATENT DOCUMENTS

| | | | |
|---|---|---|---|
| CN | 102297132 | | 12/2011 |
| CN | 103016341 | | 4/2013 |
| CN | 103047136 | | 4/2013 |
| JP | H04-255589 | A | 9/1992 |
| JP | H09-217690 | A | 8/1997 |
| JP | 2001-200795 | A | 7/2001 |
| KR | 10-2013-0031735 | | 3/2013 |

OTHER PUBLICATIONS

Chinese Office Action dated Aug. 15, 2016 issued in Application No. 201480024407.6 (with English Translation).

* cited by examiner

SCROLL COMPRESSOR HAVING AN AREA OF BYPASS HOLES FORMED AT A COMPRESSION CHAMBER WITH A LARGER VOLUME REDUCTION GRADIENT LARGER THAN AN AREA OF BYPASS HOLES AT THE OTHER COMPRESSION CHAMBER

CROSS-REFERENCE TO RELATED PATENT APPLICATIONS

This application is a U.S. National Stage Application under 35 U.S.C. §371 of PCT Application No. PCT/KR2014/004460, filed May 19, 2014, which claims priority to Korean Patent Application No. 10-2013-0057316, filed May 21, 2013, whose entire disclosures are hereby incorporated by reference.

TECHNICAL FIELD

The present disclosure relates to a scroll compressor, and more particularly, to a scroll compressor formed to have different volume reduction gradients for both compression chambers.

BACKGROUND ART

Scroll compressor is a compressor in which a compression chamber continuously moving between a fixed wrap and an orbiting wrap while an orbiting scroll performs orbiting movement with respect to a fixed scroll in a state that the fixed wrap of the fixed scroll is engaged with the orbiting wrap of the orbiting scroll is formed to inhale and compress refrigerant.

The scroll compressor continuously performs inhalation, compression and discharge, and thus has excellent characteristics in terms of vibration and noise generated during its operational process compared to other types of compressors.

The behavior characteristic of a scroll compressor is determined by its type of the fixed wrap and orbiting wrap. The fixed wrap and orbiting wrap may have an arbitrary shape, but typically have an involute curved shape that can be easily processed. The involute curve denotes a curve corresponding to a trajectory drawn by a cross section of thread when unloosing thread wound around a base circle having an arbitrary radius. When using such an involute curve, the capacity change rate is constant because a thickness of the wrap is constant and thus the number of turns should be increased to obtain a high compression ratio, but in this case, there is a drawback of increasing the size of the compressor at the same time.

On the other hand, for the circular scroll, an orbiting wrap is typically formed at one side of a disk-shaped end plate and a boss portion is formed at a rear surface on which the orbiting wrap is not formed and connected to a rotation shaft for orbiting the circular scroll. Such a shape may form an orbiting wrap over a substantially overall area of the end plate, thereby decreasing a diameter of the end plate portion for obtaining the same compression ratio. However, on the contrary, the operating point to which a repulsive force of refrigerant is applied and the operating point to which a reaction force for cancelling out the repulsive force is applied are separated from each other in an axial direction, thereby causing a problem of increasing vibration or noise while the behavior of the circular scroll is unstabilized during the operational process.

As a method for solving such problems, there is disclosed a so-called shaft penetration scroll compressor in which a position at which the rotation shaft 1 and the circular scroll 2 are coupled to each other is formed on the same surface as that of the orbiting wrap 2*a*. In such a shaft penetration scroll compressor, the operating point of a repulsive force and the operating point of the reaction force are applied at the same position, thereby solving a problem that the circular scroll 2 is inclined.

DISCLOSURE OF INVENTION

Technical Problem

However, in such a shaft penetration scroll compressor in the related art, due to the characteristics of the shaft penetration scroll compressor, though compression gradients of both compression chambers (S1, S2) or volume reduction gradients of both compression chambers (S1, S2) are different from each other, the cross-sectional areas of bypass holes 3*b*, 3*c* provided in the fixed scroll 3 are formed to be the same to bypass part of refrigerant compressed in an intermediate compression chamber as illustrated in FIGS. 1 and 2, and thus over-compression loss is generated in a compression chamber (for example, second compression chamber) with a larger volume reduction gradient, thereby reducing the overall compression efficiency.

Solution to Problem

An object of the present disclosure is to provide a scroll compressor capable of minimizing over-compression loss in a compression chamber with a larger volume reduction gradient when volume reduction gradients (or compression gradients) of both compression chambers are different from each other.

In order to accomplish the foregoing object, there is provided a scroll compressor having both compression chambers with different volume reduction gradients, wherein the entire cross-sectional area of bypass holes formed at a compression chamber with a larger volume reduction gradient between the both compression chambers is formed to be larger than that of bypass holes at the other compression chamber.

Here, the number of bypass holes formed at a compression chamber with a larger volume reduction gradient between the both compression chambers may be formed to be greater than that of bypass holes formed at the other compression chamber.

Furthermore, the individual cross-sectional area of bypass holes formed at a compression chamber with a larger volume reduction gradient between the both compression chambers may be formed to be larger than that of bypass holes formed at the other compression chamber.

In order to accomplish the foregoing object, there is provided a scroll compressor including a fixed scroll having a fixed wrap; an orbiting scroll tooth-coupled to the fixed wrap to have an orbiting wrap forming a first and a second compression chamber on an outer and an inner surface thereof, and a rotating shaft coupling portion is formed at a central portion thereof to perform orbiting movement with respect to the fixed scroll; a rotating shaft having an eccentric portion in which the eccentric portion is coupled to a rotating shaft coupling portion of the orbiting scroll to be overlapped with the orbiting wrap in a radial direction; and a driving unit configured to drive the rotating shaft, wherein bypass holes passing through the first and the second compression chamber to the outside are formed at the fixed scroll, and the entire cross-sectional area of bypass holes passing through the second compression chamber among the bypass holes is formed to be larger than that of bypass holes passing through the first compression chamber.

Here, the number of bypass holes passing through the second compression chamber may be formed to be greater than that of bypass holes passing through the first compression chamber.

Furthermore, the individual cross-sectional area of bypass holes passing through the second compression chamber may be formed to be larger than that of bypass holes passing through the first compression chamber.

Furthermore, a protruding portion may be formed on an inner circumferential surface at an inner end portion of the fixed wrap, and a recess portion brought into contact with protruding portion to form a compression chamber may be formed on an outer circumferential surface of the rotating shaft coupling portion.

In order to accomplish the foregoing object, there is provided a scroll compressor formed with two pairs of compression chambers in which the two pairs of compression chambers are discharged through one discharge port, and bypass holes bypassing part of refrigerant prior to discharging refrigerant compressed in each compression chamber through the discharge port are formed at the each compression chamber, wherein the entire cross-sectional areas of bypass holes formed at the both compression chambers are different from each other.

Here, the volume reduction gradients of the both compression chambers may be different from each other.

Furthermore, the entire cross-sectional area of bypass holes formed at a compression chamber with a larger volume reduction gradient between the both compression chambers may be formed to be larger than that of bypass holes at the other compression chamber.

Furthermore, the number of bypass holes formed at a compression chamber with a larger volume reduction gradient between the both compression chambers may be formed to be greater than that of bypass holes formed at the other compression chamber.

Furthermore, the individual cross-sectional area of bypass holes formed at a compression chamber with a larger volume reduction gradient between the both compression chambers may be formed to be larger than that of bypass holes formed at the other compression chamber.

Advantageous Effects of Invention

In a scroll compressor according to the present disclosure, the entire cross-sectional area of bypass holes formed at a compression chamber with a larger volume reduction gradient between the both compression chambers may be formed to be larger than that of bypass holes at the other compression chamber to prevent over-compression at the compression chamber with a larger volume reduction gradient, thereby enhancing the entire efficiency of the compressor.

BEST MODE FOR CARRYING OUT THE INVENTION

Hereinafter, a shaft penetration scroll compressor according to the present disclosure will be described in detail based on an embodiment illustrated in the accompanying drawings.

Figure 1:
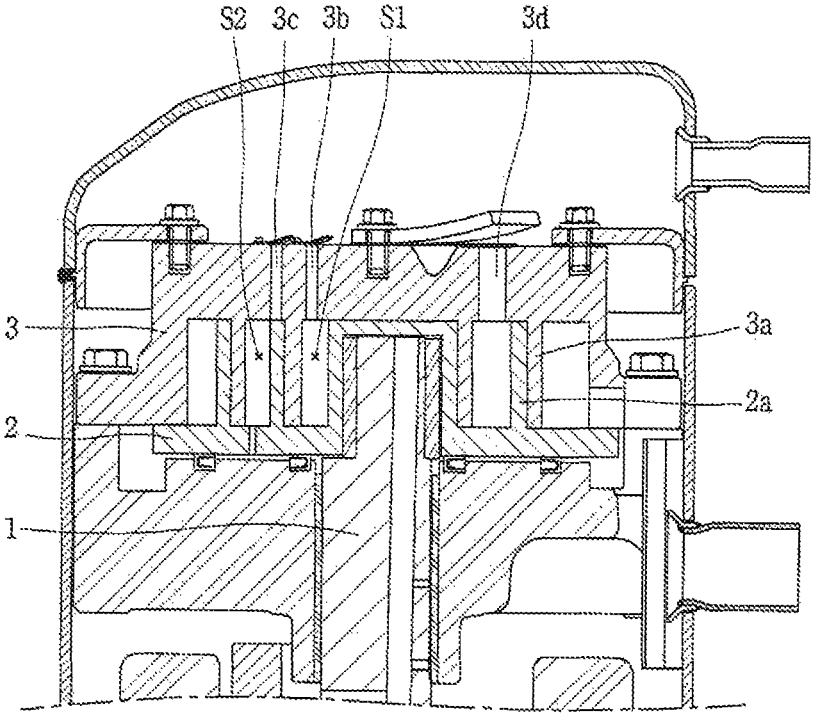
FIG. 1 PRIOR ART
FIG. 1 is a longitudinal cross-sectional view illustrating a compression unit in a shaft penetration scroll compressor in the related art.
Figure 2:
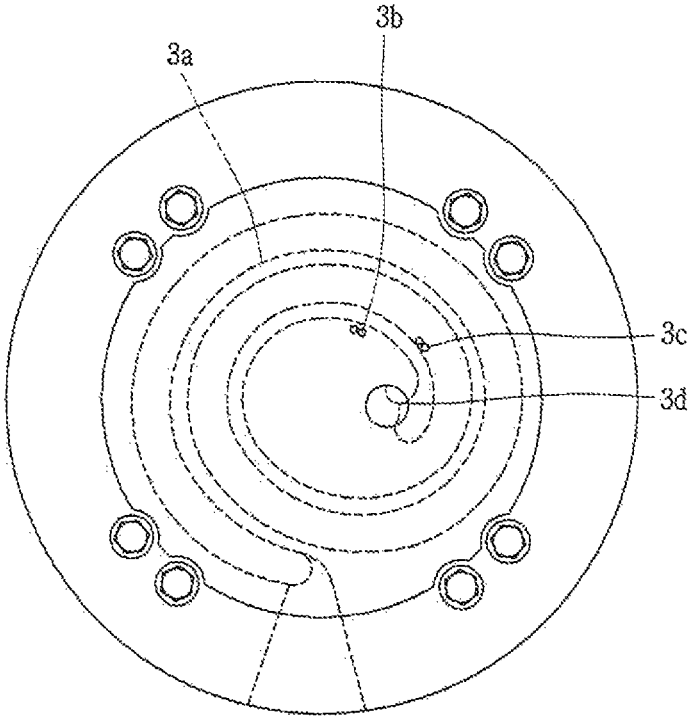
FIG. 2 PRIOR ART
FIG. 2 is a plan view illustrating bypass holes communicated with each compression chamber in a shaft penetration scroll compressor according to FIG. 1.
Figure 3:
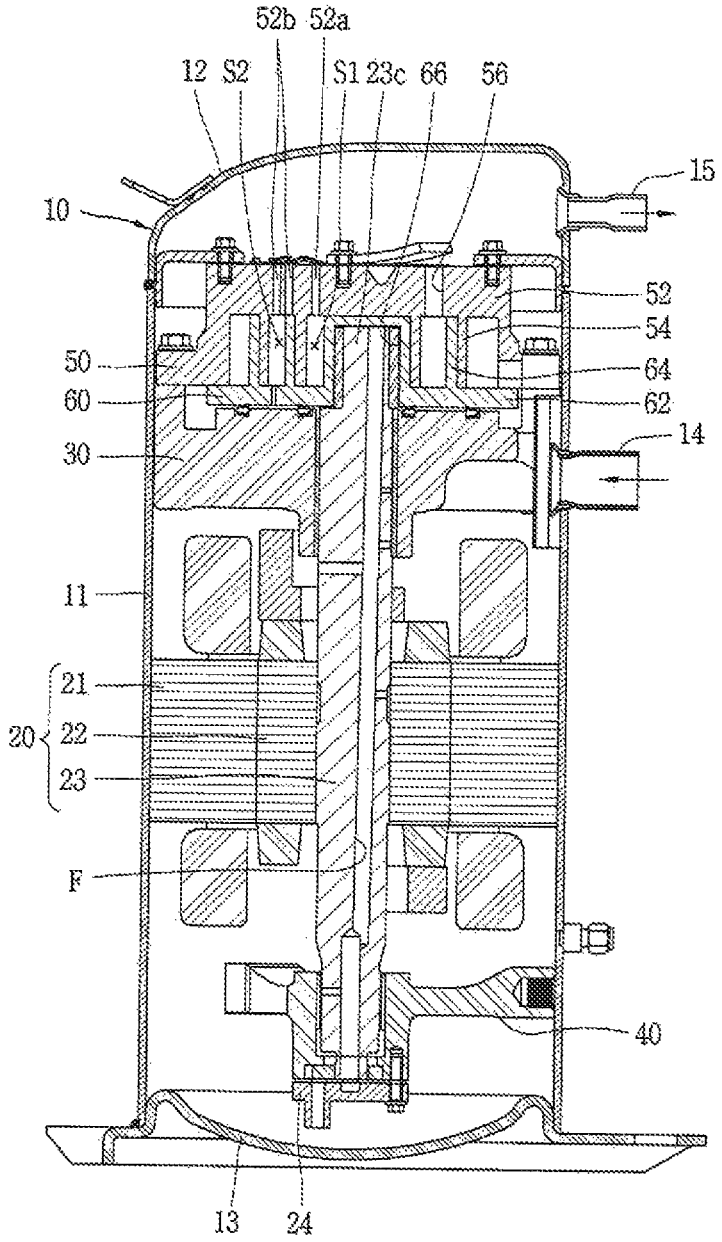
FIG. 3 is a longitudinal cross-sectional view illustrating a shaft penetration scroll compressor according to the present disclosure.
Figure 4:
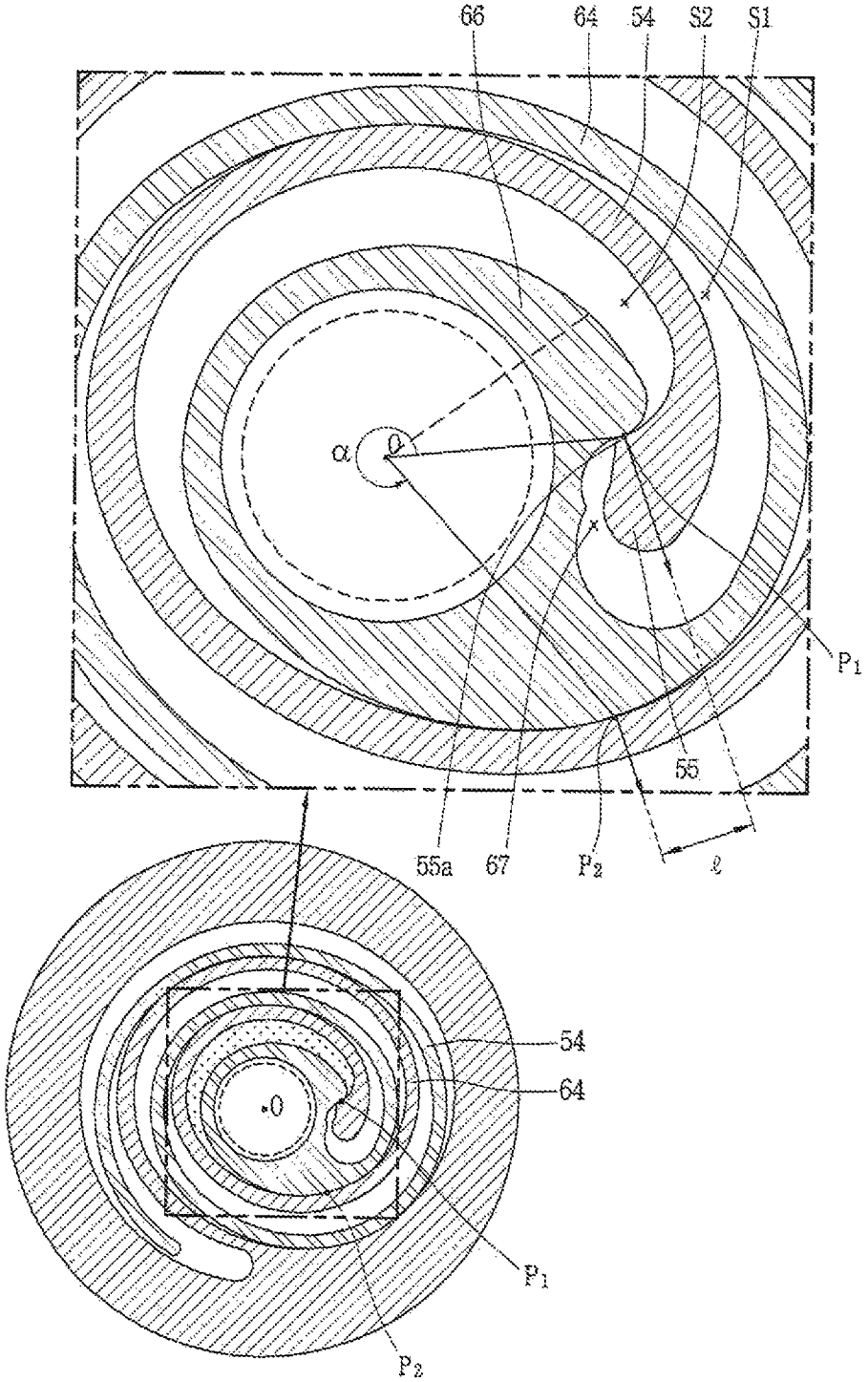
FIG. 4 is a plan view illustrating a compression unit in a shaft penetration scroll compressor according to FIG. 3.
Figure 5:
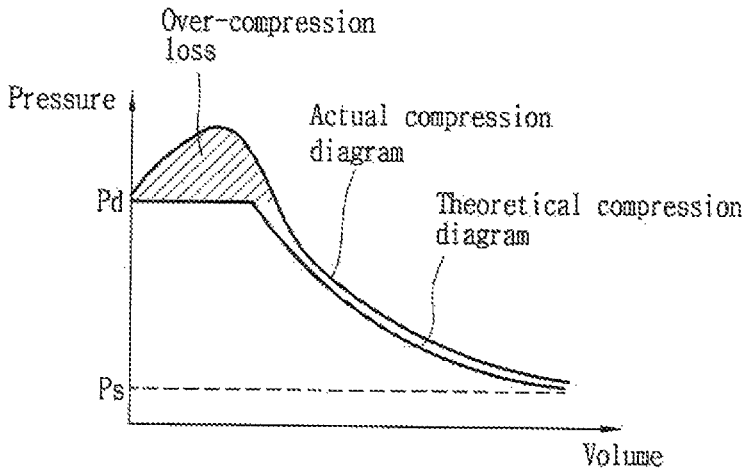
FIG. 5 is a plan view illustrating bypass holes communicated with each compression chamber in a shaft penetration scroll compressor according to FIG. 3.

FIG. 3 is a longitudinal cross-sectional view illustrating a shaft penetration scroll compressor according to the present disclosure, and FIG. 4 is a plan view illustrating a compression unit in a shaft penetration scroll compressor according to FIG. 3, and FIG. 5 is a plan view illustrating bypass holes communicated with each compression chamber in a shaft penetration scroll compressor according to FIG. 3.

As illustrated in the drawings, in a shaft penetration scroll compressor according to the present embodiment a drive motor 20 may be installed within a sealed container 10, and a main frame 30 and a sub-frame 40 may be installed at both an upper and a lower side of the drive motor 20, and a fixed scroll 50 may be fixed and installed at an upper side of the main frame 30, and a orbiting scroll 60 may be installed between the fixed scroll 50 and the main frame 30 engaged with the fixed scroll 50 and coupled to a rotating shaft 23 of the drive motor 20 to compress refrigerant while performing orbiting movement.

The sealed container 10 may include a cylindrically shaped casing 11 and an upper shell 12 and a lower shell 13 bonded and coupled to cover an upper and a lower portion of the casing 11. A suction pipe 14 may be installed on a lateral surface of the casing 10, and a discharge pipe 15 may be installed at an upper portion of the upper shell 12. The lower shell 13 functions as an oil chamber for storing oil supplied to efficiently operate the compressor.

The drive motor 20 may include a stator 21 fixed on an inner surface of the casing 10 and a rotor 22 positioned within the stator 21 to be rotated by an interaction with the stator 21. A rotating shaft 23 rotated with the rotor 22 at the same time may be coupled to the center of the rotor 22.

An oil passage (F) may be formed in a penetrated manner at a central portion of the rotating shaft 23 along the length direction of the rotor 22, and an oil pump 24 for supplying oil stored in the lower shell 13 to the upper portion thereof may be installed at a lower portion of the rotating shaft 23. A pin portion 23*c* may be eccentrically formed at an upper end of the rotating shaft 23.

An outer circumferential surface of the fixed scroll 50 may be pushed and fixed between the casing 10 and the upper shell 12 in a shrink fit manner or coupled to the casing 10 and the upper shell 12 by welding. Furthermore, a fixed wrap 54 tooth-coupled to an orbiting wrap 64 which will be described later to form a first compression chamber (S1) on an outer surface of the orbiting wrap 64 and a second compression chamber (S2) on an inner surface thereof, respectively, may be formed on a bottom surface of the end plate portion 52 of the fixed scroll 50.

The orbiting scroll 60 may be engaged with the fixed scroll 50 to be supported by an upper surface of the main frame 30. The orbiting scroll 60 may be formed with a substantially circular shaped end plate portion 62, and the orbiting wrap 64 may be formed on an upper surface of the end plate portion 62 to form two pairs of compression chambers (S1, S2) tooth-coupled to the fixed wrap 54 to continuously move. Furthermore, a substantially circular shaped rotating shaft coupling portion 66 to which the pin portion 23*c* of the rotating shaft 23 is rotatably inserted and coupled may be formed at a central portion of the end plate portion 62.

The eccentric portion 23*c* of the rotating shaft 23 is inserted and coupled to the rotating shaft coupling portion 66, and the fixed wrap 54, orbiting wrap 64 and the eccentric portion 23*c* of the rotating shaft 23 may be installed to be overlapped in a radial direction of the compressor. Here, a repulsive force of refrigerant is applied to the fixed wrap 54 and orbiting wrap 64 during compression, and a compression force is applied between the rotating shaft coupling portion 66 and eccentric portion 23*c* as a reaction force to this. As described above, when the eccentric portion 23*c* of the rotating shaft 23 passes through the end plate portion 62 of the orbiting scroll 60 to be overlapped with the wrap in a radial direction, the repulsive force and compression force of refrigerant may be applied to the same lateral surface with respect to the end plate portion 62 and thus offseted to each other.

On the other hand, the fixed wrap 54 and orbiting wrap 64 may be formed with an involute curve, but may be formed to have another curve other than the involute curve according to circumstances. Referring to FIG. 4, when the center of the rotating shaft coupling portion 66 is referred to as "O" and two contact points are referred to as P1 and P2, respectively, it is seen that angle defined by two straight lines connecting two contact points (P1, P2) to the center (O) of the rotating shaft coupling portion is less than 360 degrees, and distance l between each contact point to a normal vector is greater than "0". Accordingly, it may have a smaller volume compared to a case where the first compression chamber (S1) prior to its discharge has the fixed wrap 54 and orbiting wrap 64 formed with an involute curve, thereby increasing its compression ratio.

Furthermore, a protruding portion 55 protruded toward the rotating shaft coupling portion 66 may be formed adjacent to an inner end portion of the fixed wrap 54, and a contact portion 55*a* formed to be protruded from the protruding portion 55 may be further formed on the protruding portion 55. Accordingly, an inner end portion of the fixed wrap may be formed to have a thickness greater than that of the other portion thereof.

A recess portion 67 engaged with the protruding portion 55 may be formed on the rotating shaft coupling portion 66. One side wall of the recess portion 67 may form one side contact point (P1) of the first compression chamber (S1) while being brought into contact with the contact portion 55*a* of the protruding portion 55.

On the drawing, undescribed reference numerals 52*a*, 52*b* and 56 refer to a first bypass hole, a second bypass hole and a discharge port, respectively.

In a shaft penetration scroll compressor according to the present embodiment, when power is applied to the drive motor 20 to rotate the rotating shaft 23, the orbiting scroll 60 eccentrically coupled to the rotating shaft 23 performs orbiting movement along a predetermined path, and the first compression chamber (S1) and second compression chamber (S2) formed between the orbiting scroll 60 and the fixed scroll 50 reduce their volume while continuously moving around the orbiting movement, thereby repeating a series of processes of continuously inhaling, compressing and discharging refrigerant.

Here, as illustrated in FIG. 5, seeing an actual compression diagram for each compression chamber (S1, S2), a so-called over-compression loss in which the compression chamber is compressed over a discharge pressure (P) may occur compared to a theoretical compression diagram. Taking this into consideration, each bypass hole 52*a*, 52*b* may be formed at the fixed scroll 50 to bypass part of refrigerant compressed in a region having an intermediate pressure between a suction pressure (Ps) and a discharge pressure (Pd) in advance prior to discharging refrigerant from each compression chamber (S1, S2).

Figure 6:
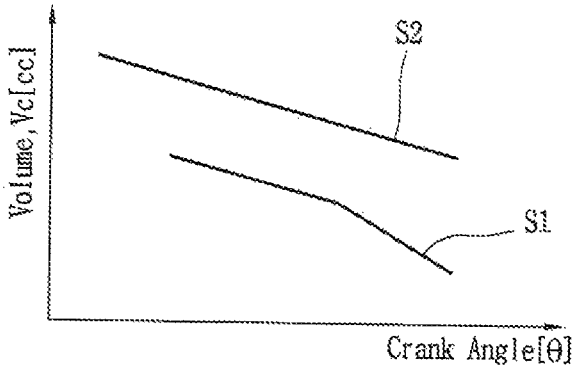
FIGS. 6 and 7 are a compression diagram and a volume diagram for a shaft penetration scroll compressor according to FIG. 3.

However, as illustrated in FIG. 6, while a volume of the first compression chamber (S1) is abruptly reduced just prior to the start of discharging, a volume reduction gradient (or compression gradient) of the first compression chamber (S1) is increased compared to that of the second compression chamber (S2). When increasing the compression gradient, over-compression which is larger than the other compression chamber (S2) occurs to reduce compression efficiency, and therefore, the entire cross-sectional area of the bypass holes 52*a* communicated with the first compression chamber (S1) may be formed to be larger than that of the bypass holes 52*b* communicated with the second compression chamber (S2), thereby preventing over-compression in the first compression chamber (S1).

Figure 7:
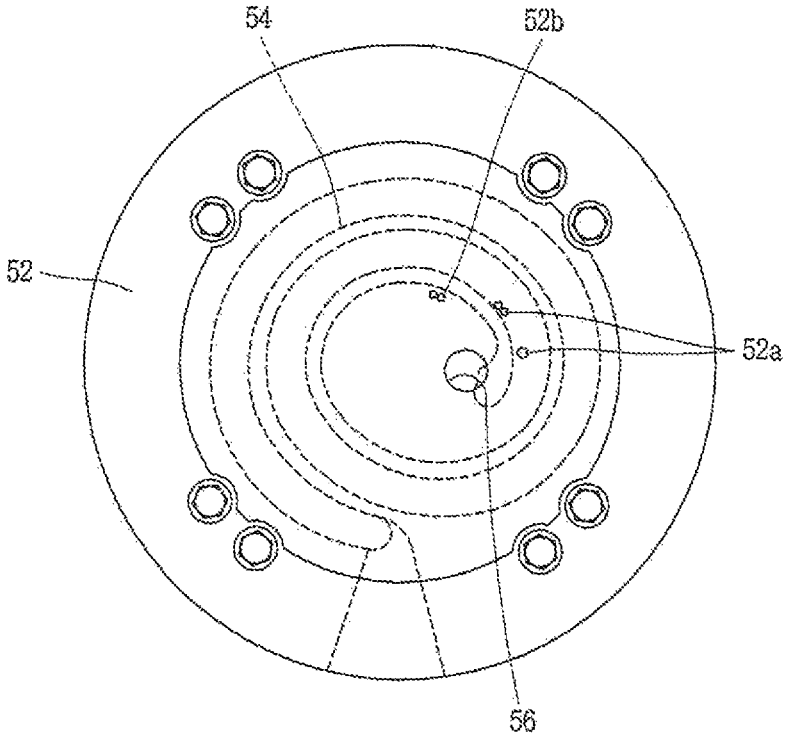

To this end, as illustrated in FIGS. 3 and 7, bypass holes communicated with the first compression chamber (S1), namely, the number of first bypass holes 52*a*, may be formed to be greater than that of bypass holes communicated with the second compression chamber (S2), thereby preventing over-compression loss at the first compression chamber (S1) occurring while a volume reduction gradient of the first compression chamber (S1) is abruptly reduced compared to that of the second compression chamber (S2).

On the other hand, even when the individual cross-sectional area of the first bypass holes 52*a* is formed to be larger than that of the second bypass holes 52*b* while the number of the first bypass holes 52*a* is the same as that of the second bypass holes 52*b*, it may be possible to obtain the same effect as that of the foregoing embodiment. Of course, in this case, a diameter of the first bypass hole 52*a* should be formed to be less than a wrap thickness of the fixed wrap 54 to prevent refrigerant leakage between both compression chambers.

As a result, the entire cross-sectional area of first bypass holes formed at the first compression chamber with a larger volume reduction gradient between the both compression chambers may be formed to be larger than that of second bypass holes at the second compression chamber to prevent over-compression at the first compression chamber, thereby enhancing the entire efficiency of the compressor.

The invention claimed is:

1. A scroll compressor having compression chambers with different volume reduction gradients, wherein an entire cross-sectional area of bypass holes formed at a compression chamber with a larger volume reduction gradient between the compression chambers is formed to be larger than an entire cross-sectional area of bypass holes formed at the other compression chamber.

2. The scroll compressor of claim 1, wherein a number of the bypass holes formed at the compression chamber with the larger volume reduction gradient between the compression chambers is formed to be greater than a number of the bypass holes formed at the other compression chamber.

3. The scroll compressor of claim 1, wherein an individual cross-sectional area of the bypass holes formed at the compression chamber with the larger volume reduction gradient between the compression chambers is formed to be larger than an individual cross-sectional area of the bypass holes formed at the other compression chamber.

4. A scroll compressor, comprising:

a fixed scroll having a fixed wrap;

an orbiting scroll coupled to the fixed scroll, and having an orbiting wrap forming a first compression chamber and a second compression chamber on an outer and an inner surface of the orbiting wrap and a rotational shaft coupling portion formed at a central portion of the orbiting wrap to perform orbiting movement with respect to the fixed scroll, wherein a volume reduction gradient of the first compression chamber is larger than a volume reduction gradient of the second compression chamber;

a rotational shaft having an eccentric portion which is coupled to the rotational shaft coupling portion of the orbiting scroll to be overlapped with the orbiting wrap in a radial direction; and a drive configured to drive the rotational shaft, wherein bypass holes passing from the first compression chamber and the second compression chamber to an outside are formed at the fixed scroll, and wherein an entire cross-sectional area of the bypass holes passing from the first compression chamber to the outside is formed to be larger than an entire cross-sectional area of the bypass holes passing from the second compression chamber to the outside.

5. The scroll compressor of claim 4, wherein a number of the bypass holes passing from the first compression chamber to the outside is formed to be greater than a number of the bypass holes passing from the second compression chamber to the outside.

6. The scroll compressor of claim 4, wherein an individual cross-sectional area of the bypass holes passing from the first compression chamber to the outside is formed to be larger than an individual cross-sectional area of the bypass holes passing from the second compression chamber to the outside.

7. The scroll compressor of claim 4, wherein a protrusion is formed on an inner circumferential surface at an inner end portion of the axed wrap, and wherein a recess which is brought into contact with the protrusion to form a compression chamber is formed on an outer circumferential surface of the rotational shaft coupling portion.

8. The scroll compressor of claim 4, wherein the fixed scroll includes an end plate, and wherein the fixed wrap is formed on a bottom surface of the end plate of the fixed scroll.

9. The scroll compressor of claim 8, wherein the bypass holes passing through the first compression chamber and the second compression chamber to the outside are formed at the end plate of the fixed scroll.

10. The scroll compressor of claim 8, wherein the orbiting scroll includes an end plate, wherein the orbiting wrap is formed on an upper surface of the end plate of the orbiting scroll, and wherein the fixed wrap is coupled to the orbiting wrap.

11. The scroll compressor of claim 4, further including:

a sealed container including a cylindrical shaped casing, an upper shell coupled to an upper portion of the casing, and a lower shell coupled to a lower portion of the casing;

a suction pipe penetratingly installed on a lateral surface of the casing; and a discharge pipe penetratingly installed at an upper portion of the upper shell.

12. The scroll compressor of claim 11, further including a main frame installed in the casing at an upper side of the drive, wherein the fixed scroll is installed at an upper side of the main frame.

13. The scroll compressor of claim 12, wherein the orbiting scroll is installed between the fixed scroll and the main frame, and wherein the orbiting scroll is supported by an upper surface of the main frame.

14. The scroll compressor of claim 11, wherein the drive includes a drive motor installed in the sealed container, wherein the drive motor includes:

a stator fixed on an inner surface of the casing; and a rotor rotated by an interaction with the stator positioned within the stator, and wherein the rotational shaft is coupled to the rotor to drive the rotational shaft.

15. A scroll compressor formed with a pair of compression chambers, wherein a refrigerant being discharged from the pair of compression chambers is discharged through one discharge port, wherein volume reduction gradients of the pair of compression chambers are different from each other, wherein bypass holes bypassing a portion of the refrigerant prior to discharging the refrigerant compressed in each of the pair of compression chambers through the discharge port are formed at each of the pair of compression chambers, wherein an entire cross-sectional areas of the bypass holes formed at the pair of compression chambers, respectively, are different from each other, and wherein the entire cross-sectional area of the bypass holes formed at a compression chamber of the pair of the compression chambers with a larger volume reduction gradient between the pair of compression chambers is formed to be larger than an entire cross-sectional area of the bypass holes formed at the other compression chamber of the pair of compression chambers.

16. The scroll compressor of claim 15, wherein a number of the bypass holes formed at the compression chamber of the pair of compression chambers with the larger volume reduction gradient between the pair of compression chambers is formed to be greater than a number of the bypass holes formed at the other compression chamber of the pair of compression chambers.

17. The scroll compressor of claim 15, wherein an individual cross-sectional area of the bypass holes formed at the compression chamber of the pair of compression chambers with the larger volume reduction gradient between the both the pair of compression chambers is formed to be larger than an individual cross-sectional area of the bypass holes formed at the other compression chamber of the pair of compression chambers.

* * * * *